US007475503B2

(12) United States Patent
Iannarelli et al.

(10) Patent No.: US 7,475,503 B2
(45) Date of Patent: Jan. 13, 2009

(54) BUMPER FOR A BACKHOE BOOM

(75) Inventors: Philip A. Iannarelli, Rhinelander, WI (US); Marc D. Buhmeyer, Burlington, IA (US)

(73) Assignee: CNH America LLC, New Holland, PA (US)

( * ) Notice: Subject to any disclaimer, the term of this patent is extended or adjusted under 35 U.S.C. 154(b) by 595 days.

(21) Appl. No.: 11/079,307

(22) Filed: Mar. 14, 2005

(65) Prior Publication Data

US 2006/0231992 A1 Oct. 19, 2006

(51) Int. Cl.
*E02F 3/40* (2006.01)

(52) U.S. Cl. ..... 37/444; 267/139; 267/140; 293/102

(58) Field of Classification Search ..... 37/443, 37/444, 466; 267/139, 140; D12/167; 293/102
See application file for complete search history.

(56) References Cited

U.S. PATENT DOCUMENTS

| | | | | |
|---|---|---|---|---|
| 2,649,295 | A | 8/1953 | Schuyler | |
| RE24,276 | E * | 2/1957 | Schuyler | 267/140 |
| 2,799,494 | A | 7/1957 | Pollock | |
| 2,986,827 | A | 6/1961 | Peterson | |
| 3,096,973 | A * | 7/1963 | Bergen | 267/140 |
| 3,353,812 | A | 11/1967 | Miller | |
| 3,721,458 | A | 3/1973 | Mitchell | |
| 3,794,296 | A | 2/1974 | Hasstedt | |
| 3,929,239 | A | 12/1975 | Shumaker | |
| 3,987,914 | A | 10/1976 | VanDerZyl et al. | |
| 4,039,206 | A | 8/1977 | Nault | |
| 4,624,106 | A | 11/1986 | Mickelson et al. | |
| 5,486,084 | A | 1/1996 | Pitman et al. | |
| 5,661,934 | A * | 9/1997 | Weisflog | 52/173.2 |
| 6,109,650 | A * | 8/2000 | Lagsdin | 280/763.1 |
| 6,444,067 | B1 | 9/2002 | Bove et al. | |
| 6,471,246 | B1 | 10/2002 | Lagsdin | |
| 6,607,347 | B2 | 8/2003 | Burgo | |
| 6,634,672 | B1 | 10/2003 | Lagsdin | |
| 2001/0010796 | A1 | 8/2001 | Burgo | |
| 2003/0011181 | A1 | 1/2003 | Lagsdin | |

* cited by examiner

*Primary Examiner*—Gary S Hartmann
(74) *Attorney, Agent, or Firm*—Patrick M. Sheldrake; John William Stader; Michael G. Harms

(57) ABSTRACT

A bumper for a backhoe boom includes a plate for mounting to the backhoe, two rods threaded at both ends that are cantilevered away from the mounting plate, and two stacks of rubber plates mounted on the threaded rods on either side of the mounting plate. The two stacks of rubber plates are secured to the threaded rods with nuts. The nuts abut two retaining plates that press against the stacks of rubber plates.

9 Claims, 2 Drawing Sheets

BUMPER FOR A BACKHOE BOOM

FIELD OF THE INVENTION

The present invention relates generally to shock-absorbing bumpers. More particularly, a relates to bumpers for booms on backhoes.

BACKGROUND OF THE INVENTION

Bumpers made of stacks of rubber plates are common in the art. They are used in a variety of places such as loading docks and pads for construction vehicle outriggers.

The stacks are usually quite large, consisting of from 8 rubber plates to as many as 50 or 100 rubber plates. In loading docks, for example, 50 or more rubber plates are threaded onto steel rods that extend several feet across the back of the loading dock. To make sure the plates retain their shape, they are often compressed between two steel plates fixed to the loading dock that are disposed on either end of the rubber plate stack.

The plates in each stack are typically fused together to provide longer life and better wear. To further enhance wear, the plates are typically compressed tightly between the angle iron or plates at each end. This prevents relative movement between adjacent plates and makes them collectively quite rigid.

Unfortunately, this rigidity is not desirable in many applications. For example, backhoe bumpers used to stop backhoe booms must be flexible in order to conform to the surface contours of a backhoe boom. They must also be flexible to absorb shocks when the backhoe boom is stowed and bangs against the bumper.

It is an object of this invention to provide a bumper for a backhoe boom that provides this flexibility and shock absorption.

SUMMARY OF THE INVENTION

According to one aspect of the invention, a bumper for a backhoe boom comprises a mounting plate, at least two rods fixed to the plate, and two stacks of rubber plates mounted on free ends of the rods.

Nuts may be fixed to free ends of the rods to hold the stacks in place. The rods are parallel to one another and parallel to the surface of the backhoe on which the bumper is mounted. The plates in each stack of plates are not bonded or fused to each other. The two stacks may be mounted on opposite sides of the mounting plate. The rods may be cantilevered away from the mounting plate. The rods may be threaded on both ends. The rods preferably extend the same distance away from the mounting plate and are unsupported at their outer ends.

DETAILED DESCRIPTION OF THE PREFERRED EMBODIMENTS

Figure 3:
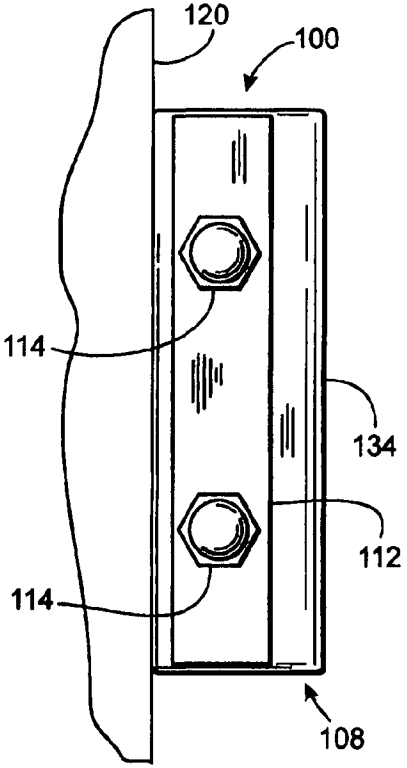
FIG. 3 is a side view of the bumper of FIGS. 1-2.
Figure 1:
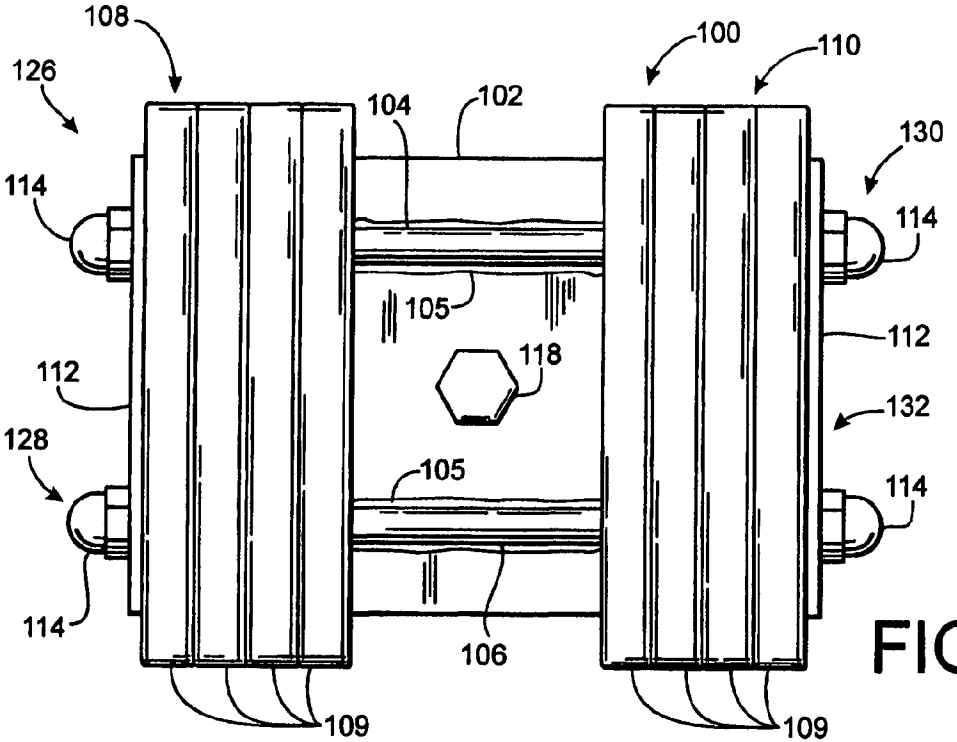
FIG. 1 is a plan view of the bumper fixed to a swing tower of a backhoe.
Figure 2:
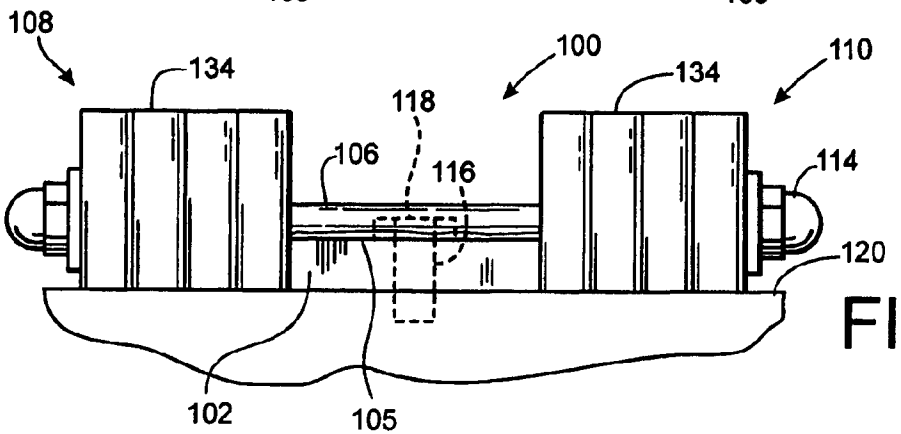
FIG. 2 is an end view of the bumper of FIG. 1.

While the present invention is susceptible of being made in any of several different forms, the drawings show a preferred form of the invention. One should understand, however, that this is just one of many ways the invention can be made. Nor should any feature of the illustrated embodiment be considered a part of the invention, unless that feature is mentioned in the claims. In the drawings, like reference numerals refer to like parts throughout the several views.

FIGS. 1-6 show a bumper 100 for the boom of a backhoe. Bumper 100 includes a base plate 102; two threaded rods 104, 106 fixed to the base plate; a first stack 108 of rubber plates 109 fixed to one end of threaded rods 104, 106; a second stack 110 of rubber plates 109 fixed to the other end of threaded rods 104, 106; two retaining plates 112 disposed on both ends of threaded rods 104, 106; and a means for securing the rubber plates to the rods, shown here as four cap nuts 114 threaded onto the free ends of each of threaded rods 104, 106.

Base plate 102 is generally planar, rectangular, and elongated vertically. It defines a mounting hole 116 passing through the middle of the plate from one side of the plate to the opposite side of the plate. Hole 116 is configured to receive a threaded fastener 118 that extends through plate 102 and into boom tower 120 to secure bumper 100 to the boom tower. The bottom surface of plate 102 mounts to tower 120 and the top surface of plate 102 supports rods 104, 106.

Threaded rods 104, 106 are fixed to the surface of plate 102 generally parallel to the surface of boom tower 120, parallel to each other, and parallel to the top and bottom surfaces of plate 102. They have the same length. Rods 104, 106 are preferably welded to the surface of plate 102 by weldments 105. Each of rods 104, 106 has two free ends. Both free ends of both rods are threaded to threadedly engage cap nuts 114. Rods 104, 106 extend past the outer edges of plate 102 and are held by plate 102 in a spaced apart and parallel relation to the surface of boom tower 120. All four free ends of rods 104, 106 extend the same distance away from plate 102, having the same unsupported free length. Rods 104, 106 are spaced apart from one another a constant distance over their entire lengths. Rods 104, 106 are oriented parallel to the surface of boom tower 120 and are spaced apart from it.

The free ends 126, 128 of rods 104, 106 extending from a first side of plate 102 support a stack of rubber plates 108. Each rubber plate 109 of plates 108 is generally rectangular and has two holes 122, 124 through which free ends 126, 128 extend. Free ends 126, 128 protrude through plates 108 sufficient to support a retaining plate 112 that is mounted on both rod ends 126, 128, and a cap nut 114 threaded to each free end 126, 128 to retain the retaining plate 112 and stack 108 of rubber plates 109.

Retaining plates 112 are mounted across the free end face of the last rubber plate. Plates 112 prevent the last rubber plate (and hence the other plates in the stack) from buckling, and distribute the pressure applied by the nuts across the entire face of the stack of rubber plates.

Rods 104, 106 also have second free ends 130, 132 extending from a second side of plate 102 opposite the first side of plate 102. Free ends 130, 132 support another stack of rubber plates 110. Each rubber plate 109 of plates 110 is generally rectangular and has two holes 122, 124 through which free ends 130, 132 extend. Free ends 130, 132 protrude through plates 110 sufficient to support a retaining plate 112 that is mounted to both rod ends 130,132, and a cap nut 114 that is threaded to each free end 130, 132 to retain the retaining plate 112 and stack 110 of rubber plates 109.

Figure 6:
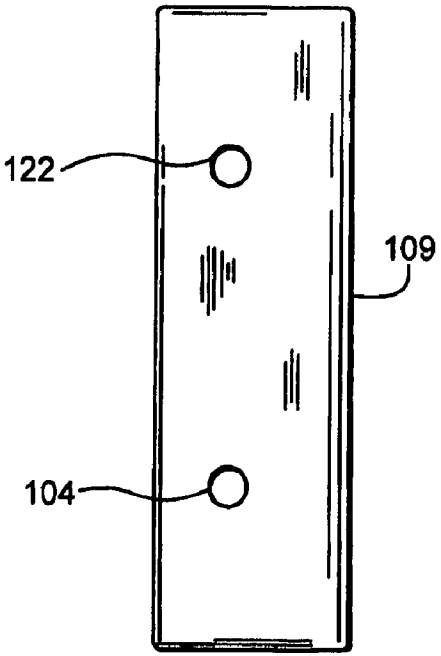
FIG. 6 is a plan view of a rubber plate for the bumper of the foregoing Figures.
Figure 4:
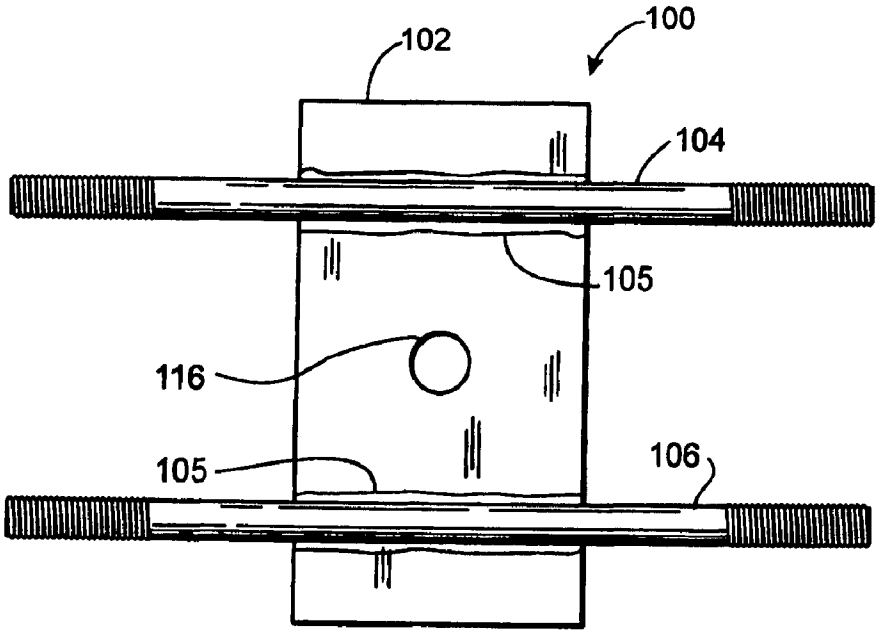
FIG. 4 is a plan view of the plate support for the bumper of the foregoing Figures.
Figure 5:
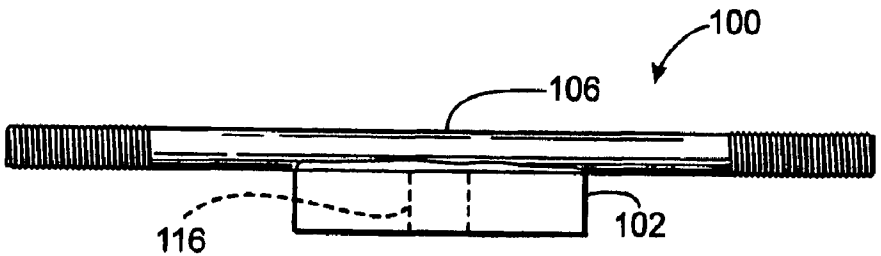
FIG. 5 is an end view of the plate support of FIG. 4.

Rubber plates 109 are shown in FIG. 6 in plan view. The plates themselves can be made of any elastomeric material, including natural and artificial elastomers, such as NBR and urethane. For reasons of economy and durability, however, plates formed from the salvaged carcasses of used truck or automobile tires are particularly suitable. The sidewalls of these carcasses are particularly well-suited and have thicknesses of between 0.25 and 0.50 inches. One feature that makes them suitable is their internal reinforcement. When the tires are manufactured, fabric or steel cords are embedded in the sidewalls and treads to give the tire additional strength. These embedded cords act as a fiber reinforcing matrix, which supports the rubber, enhancing wear resistance and tear strength.

Each of stacks 108, 110 comprise between 3 and 6 rubber plates 109, and More preferably 4 rubber plates 109 (as illustrated in the Figures). The plates in each stack are preferably not fused together. Since the plates are not fused together, they can bend and flex more easily when the backhoe boom is seated against the free outer surfaces 134 of stacks 108, 110 (see FIG. 2). This helps the plates accommodate small misalignments as well as irregularities in the surface of the backhoe boom such as draft angle and parting line. Additional flexibility can be provided by loosening the nuts.

One will appreciate that the present disclosure is intended as an exemplification of the invention, and is not intended to limit the invention to the specific embodiment illustrated. The disclosure is intended to cover by the appended claims all such modifications as fall within the scope of the claims.

For example, the nuts may be replaced with spring pins; roll pins; keys; swaged, crimped, or crushed rod ends; swaged, crimped, or crushed fasteners coupled to the rod ends; weldments; and brazing material. As another example, the rods may be replaced with square rod, sheet, bar, and ribbon stock. As a further example, the round holes in the rubber plates may be replaced with square holes, oval holes and slots. As yet another example, the rods need not be parallel to one another, or parallel to the mounting plate. As a further example, the rods need not extend from both sides of the mounting plate, they need only extend from one side. As yet another example, there need be only one rod extending through each stack of rubber plates. As a further example, the stack of plates can be replaced with one or more urethane-based shock absorbers.

We claim:

1. A bumper for a boom of a backhoe comprising:

a rectangular and elongated mounting plate, the mounting plate having opposing first and second side edges and a mounting hole extending theretrough, the mounting hole being configured to receive a threaded fastener for mounting to a backhoe surface;

two rods, each rod having first and second free ends, a portion of each respective free end threaded at first and second ends, and each rod fixed to a surface of the mounting plate, which holds the rods substantially parallel to the backhoe surface so that the first and second free ends extend from the first and second side edges, respectively;

a first stack of rubber plates secured to the first free ends of the two rods between the first side edge and the first end; and a second stack of rubber plates secured to the second free ends of the two rods between the second side edge and the second end.

2. The bumper of claim 1, further comprising nuts threaded on the two rods on both first and second ends to secure the first and second stacks of rubber plates to the rods.

3. The bumper of claim 1, wherein the two rods are welded to the mounting plate parallel to each other.

4. The bumper of claim 1, wherein all four ends of the two rods are cantilevered the same distance away from the mounting plate.

5. The bumper of claim 1, further comprising a first retaining plate secured to the first ends of the two rods and a second retaining plates secured to the second ends of the two rods.

6. A bumper for a boom of a backhoe comprising:

a rectangular and elongated mounting plate having a mounting hole extending therethrough, the mounting hole being configured to receive a threaded fastener for mounting to a backhoe surface;

two rods, each rod threaded at first and second ends, and each rod fixed to a surface of the mounting plate, which holds the rods substantially parallel to the backhoe surface and parallel to each other;

a first stack of rubber plates secured to the first ends of the two rods;

a second stack of rubber plates secured to the second ends of the two rods; and nuts threaded on the two rods on both first and second ends to secure the first and second stacks of rubber plates to the rods.

7. The bumper of claim 6, wherein the two rods are welded to the mounting plate parallel to each other.

8. The bumper of claim 6, wherein all four ends of the two rods are cantilevered the same distance away from the mounting plate.

9. The bumper of claim 6, further comprising a first retaining plate secured to the first ends of the two rods and a second retaining plates secured to the second ends of the two rods.

* * * * *